United States Patent [19]

Munini et al.

[11] Patent Number: 4,919,385

[45] Date of Patent: Apr. 24, 1990

[54] STRUCTURE TO SUPPORT A LARGE MIRROR, AND A LARGE MIRROR EMPLOYING THAT STRUCTURE

[75] Inventors: Dino Munini, S. Quirino; Franco Marcorin, Cinto Caomaggiore, both of Italy

[73] Assignee: Imago Flama Sas di Pasquinelli Mauro & C., Pravisdomini, Italy

[21] Appl. No.: 328,321

[22] Filed: Mar. 24, 1989

[30] Foreign Application Priority Data

Apr. 6, 1988 [IT] Italy ..... 83362 A/88

[51] Int. Cl.[5] ..... A47F 7/14

[52] U.S. Cl. ..... 248/475.1; 206/453; 248/220.1

[58] Field of Search ..... 248/475.1, 466, 489, 248/480, 201, 205.1, 220.1; 350/631; 206/453, 454; 40/152

[56] References Cited

U.S. PATENT DOCUMENTS

| | | | |
|---|---|---|---|
| 2,538,386 | 6/1951 | Schneider . | |
| 2,793,566 | 5/1957 | Burtchaell | 248/475.1 X |
| 3,018,690 | 1/1962 | Magrauth . | |
| 3,476,927 | 11/1968 | Rothman . | |
| 4,549,786 | 10/1985 | Albers et al. | 350/631 X |
| 4,643,544 | 2/1987 | Loughran | 350/631 X |
| 4,700,844 | 10/1987 | Griffith | 206/453 X |

FOREIGN PATENT DOCUMENTS

| | | |
|---|---|---|
| 1914536 | 3/1969 | Fed. Rep. of Germany . |
| 8524563.1 | 12/1985 | Fed. Rep. of Germany . |
| 8712001 | 3/1987 | Fed. Rep. of Germany . |
| 725987 | 12/1968 | France . |

OTHER PUBLICATIONS

European Search Report.

*Primary Examiner*—Ramon O. Ramirez
*Attorney, Agent, or Firm*—Nixon & Vanderhye

[57] ABSTRACT

Structure to support a large mirror, cupboard doors and hanging cupboard doors with mirrors, two-face partition panels with mirrors or other items, the structure comprising a plurality of lateral sections (10) equipped with means (12–13) to support at least one small mirror (17) and a rear panel (20), a volume of space (22) being included between the lateral sections (10), the at least one small mirror (17) and the rear panel (20), the lateral sections (10) being united by means of angular elements (19) which cooperate with guide means (15–27) and with two neighbouring lateral sections (10) respectively, the lateral sections (10) comprising means (14) to support the rear panel (20), the volume of space (22) being filled with injected foam material which binds solidly together all the elements forming the large mirror.

6 Claims, 3 Drawing Sheets

STRUCTURE TO SUPPORT A LARGE MIRROR, AND A LARGE MIRROR EMPLOYING THAT STRUCTURE

This invention concerns a structure to support a large mirror, cupboard doors and hanging cupboard doors with mirrors, two-face partition panels with mirrors or other items.

To be more exact, the invention concerns a support structure for a large mirror, the structure ensuring a secure support for the mirror and being light, economical and easy to fit.

The invention concerns also a large mirror provided with such a support structure.

Support structures for large mirrors are known which consist of metallic frames, generally brass frames, equipped on their inside with lead inserts that enable the frames to be adapted to the shapes of the mirrors.

When the mirror and frames have been united, the latter are fixed by a soldering process, and lastly a reinforcing cover comprising chipboard panels is positioned at the rear of the structure so as to strengthen it and thus to increase its steadiness.

If more frames than one are placed in contact, then the brass-lead elements are sheared and treated with an acid for subsequent welding.

This method entails shortcomings and drawbacks due to the fact that the acid corrodes the visible surface of the frames and mirror in many cases with resulting damage to the appearance.

Moreover, the known structure is generally unsatisfactory since it is heavy and hard to fit together, especially when the large mirror is provided with many small mirrors fitted side by side.

Furthermore, these types of large mirror are not prepared normally for the insertion of electrical equipment (electrical sockets, lighting for the mirror), do not include air passages and have to be adapted individually to their subsequent usage conditions; they therefore have a high cost.

DE-OS-No. 1914536 discloses a system to produce doors and main doors whereby a panel of a foam plastic material is injected successively between the boards forming the two faces so that the panel, when hardened, keeps the structure of the door or main door united. If necessary, intermediate reinforcement plies may be introduced readily into the intermediate space, for instance in the area of the lock or hinges of the door, and be fixed in the same way in position by means of the injected foam plastic material. The foam panel prevents circulation of air in the intermediate space and therefore the formation of condensation between the boards and also protects that part between the boards against the effect of corrosion. This document describes the production of doors but not of mirrors consisting of a plurality of elements lying on one and the same plane and having different natures. Moreover, this document discloses a technique requiring very powerful machines to arrange the panels and their positioning on the same plane with a slight sag due to flexure in view of the fact that the foam material has very little capacity to withstand the deforming thrusts.

DE-GM-No. 8524563.1 discloses a mirror, in particular a faceted mirror with many elements of the mirror secured to a common support and support plates respectively, whereby support frames are included and are secured to the support plate and, by gripping its edge, adhere to the element and elements of the mirror respectively. In this element the support plate is decisive, so that if this plate were eliminated or it were not possible to connect it rigidly with screws to the retention frame, this teaching would have no value. Besides, according to the teaching of this document the mirrors have to have a second bevelling by grinding so as to be able to cooperate with the support frames and this makes the embodiment more costly.

This invention has the purpose of obviating the drawbacks and shortcomings of the state of the art and therefore of providing a structure for a large mirror which is simple, light and of a modest cost and does not require special machines and which at the same time complies with satisfactory criteria of appearance, enables standardized electrical equipment to be inserted and ensures a sufficient passage of air at the rear of the mirror, such passage being required to obtain good preservation of the wall by avoiding moulds and changes of colour of the paint and of the mirror itself.

These and other purposes are achieved by a support structure for a large mirror which possesses the features of the main claim.

The dependent claims describe preferred forms of embodiment of the invention.

The structure according to the invention consists of a pair of metallic lateral support sections each of which is equipped with two arms that define a slot able to accommodate and retain the edge of a mirror resiliently. The edge should not include special bevelling.

If the large mirror is provided with a plurality of mirrors, the structure comprises also intermediate sections equipped with two pairs of arms that define two adjacent slots, each of which is able to accommodate the edge of a mirror without special bevelling.

According to the invention the lateral sections are provided with a protrusion located in a plane parallel to the surface of the mirror and intended to support a rear panel made of a laminated or extruded plastic material, aluminized board, wood or another analogous material that forms the rear of the large mirror.

According to a feature of the invention the lateral sections are also equipped with multi-purpose angular closure elements, which ensure clamping of the sections, aesthetic finishing of the corners, distancing of the large mirror from the support wall and seatings for the support hook of the large mirror.

According to another feature of the invention the volume of space delimited by the lateral sections, the rear panel and the mirror respectively is filled with foam material of a polyurethane type injected into the volume.

Owing to the natural rigidity of the mirrors only an accurate positioning of the elements is needed to withstand the thrust generated by the expansion of the foam material.

In this case the angular closure elements will also act as a seal for the corners to prevent any outflow of the polyurethane and also will act for dimensional retention of the mirrors.

According to an advantageous form of embodiment of the invention, before the polyurethane foam is injected, the rear of the mirrors is treated, normally by spraying, with a sealing substance or varnish to ensure retention of the foam between the mirrors and to protect the latter against chemical attack by the foam in the long term.

According to another form of embodiment of the invention the structure includes standardized boxes for fixture of electrical elements (electrical sockets, switches, lights), the boxes containing inlets for connecting tubes for wiring harnesses, the tubes being fixed under pressure, or else containing tubes that enter through holes provided in the boxes themselves.

Further advantages of the invention will become evident after reading the following description of one form of embodiment of the invention, the description being given as a non-restrictive example, together with the help of the figures shown in the attached table, in which.

Figure 7:
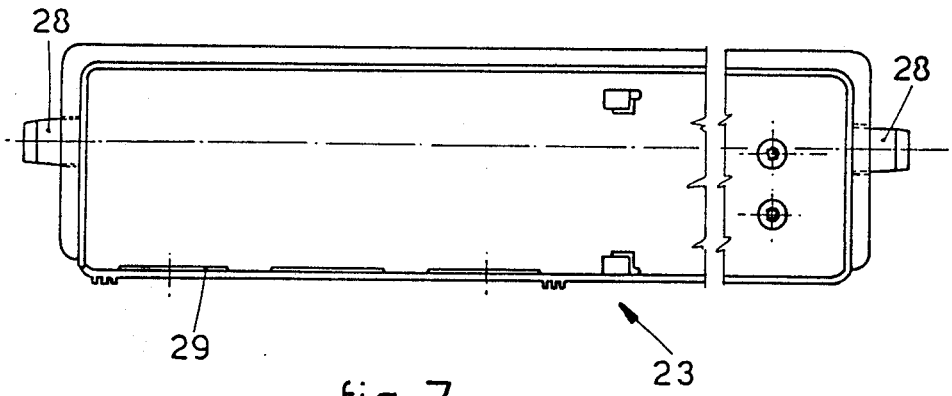
Figure 6A:
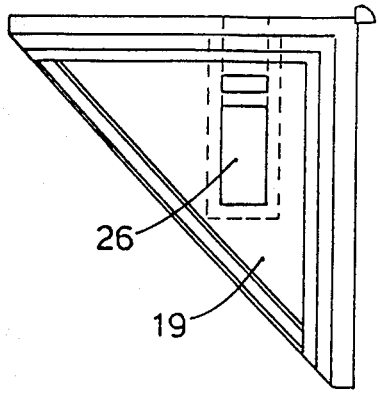
Figure 6B:
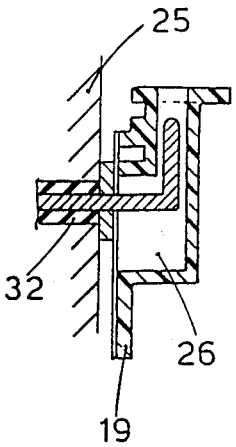
Figure 6C:
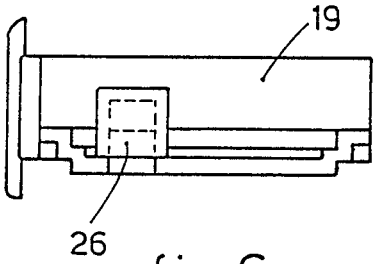
Figures 8A, 8B:
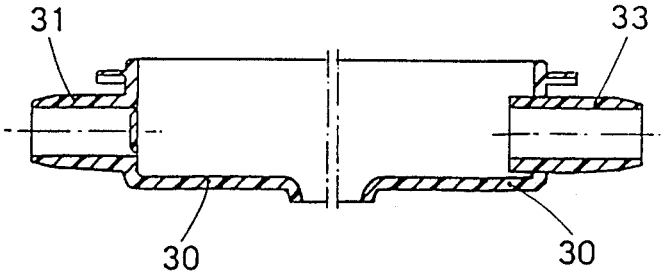

FIGS. 6*a*, 6*b* and 6*c* show three views of an angular element;

FIG. 7 shows from above a view of a box for electrical connection elements;

FIGS. 8*a* and 8*b* show a lateral section of a box for an element forming a light.

The figures reference with 10 a metallic section for lateral support of a large mirror. This section 10 comprises an elongate flat element 11, from one end of which there protrudes a pair of first 12 and second 13 arms forming a fork intended to accommodate the edge of a mirror, while from the other end there protrudes a third arm 14 which forms a support for a rear panel.

The lateral sections 10 comprise openings intended to lodge standardized boxes 23 able to enclose electrical connection and actuation elements.

A first protrusion 15 juts from the third arm 14 and its purpose will be described better hereinafter.

In the same way a second protrusion 27 juts from the second arm 13.

Figure 5:
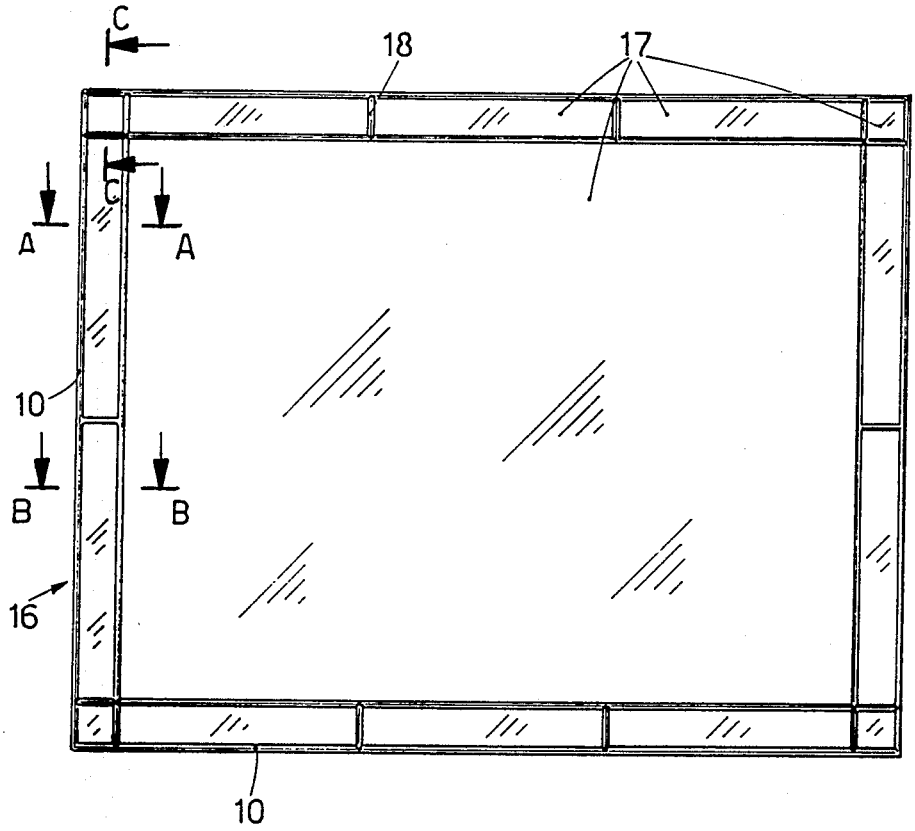
FIG. 5 shows a front view of a support structure according to the invention.

In FIG. 5 a large mirror 16 comprises a pair of sections 10 and a plurality of small mirrors 17 separated by intermediate elements 18.

Angular elements 19 complete the frame of the mirror.

Figure 2:
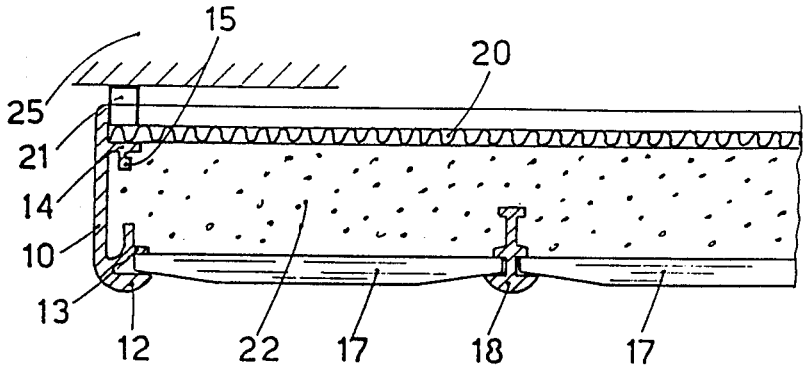
FIGS. 2, 3 and 4 show the sections A—A, B—B and C—C respectively of FIG. 5.

FIG. 2 shows the section A—A of FIG. 5. In this figure can be seen firstly a section 10 of which the first and second arms 12–13 receive and guide the edge of a small mirror 17, secondly an intermediate element 18 provided with two pairs of arms to support and guide a rear panel 20 consisting generally of a laminated plastic material supported by the third arm 14 of the section 10, and thirdly a spacer element 21 forming part possibly of the angular element 19 and acting as a distance block intended to keep the mirror at a given distance from a supporting wall 25.

A volume 22 of space enclosed by the section 10, mirrors 17 and rear panel 20 is filled according to the invention with a synthetic foam material of a polyurethane type injected into that volume 22.

Figure 3:
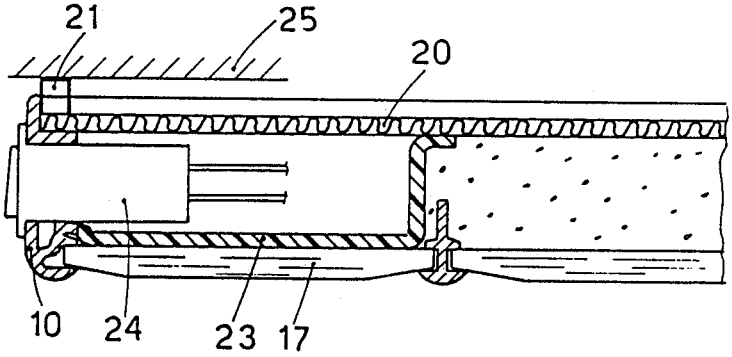

FIG. 3 shows, besides the elements mentioned above, a standardized box 23 for fixture of electrical elements such as a switch 24 for instance.

Figure 4:
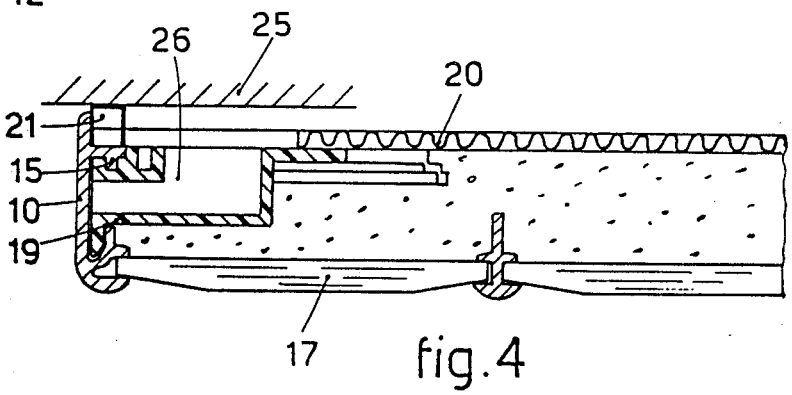

FIG. 4 shows also an angular element 19 provided with a hole 26 intended to accommodate a hook of an expansion-type fixture plug (not shown here) for fixture of the mirror to the wall 25.

Figure 1:
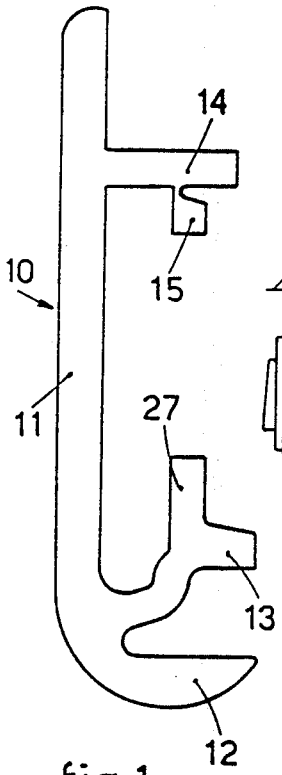
FIG. 1 shows from above a lateral section bar of a structure according to the invention.

The angular element 19 cooperates with the section 10 by means of a fixed joint between the first and second protrusions 15–27 and the elongate flat element 11 (see FIG. 1).

Likewise, FIG. 6*b* shows an expansion-type fixture plug 32 secured to the wall 25 and bearing a hook that cooperates with the angular element 19.

Such angular element 19 is shown in greater detail in FIGS. 6*a*, 6*b* and 6*c*. It is normally intended to cooperate with two neighbouring sections 10 so as to obtain reciprocal fixture and clamping.

FIG. 7 gives a plan view of a standardized box 23 suitable to contain electrical connection and actuation elements such as switches, transformers, sockets and various harnesses of wire, for instance.

The box 23 is therefore provided with holes 28 for the entry of wires and openings 29 intended to accommodate the actuation elements.

Lastly, FIGS. 8*a* and 8*b* give a section view of a generally cylindrical box 30 provided with a hole 31 (FIG. 8*a*) for the passage of wires or of a wire-containing tube 33 (FIG. 8*b*). This box 30 can be inserted at various points in the mirror and can cooperate in the fixture of an element forming part of the lighting equipment, a halogen light for instance.

The support structure according to the invention is assembled by inserting the small mirrors 17 in the slots formed by the first and second arms 12-13 of the sections 10 and perhaps in the slots of the intermediate elements 18 and by fitting the angular elements 19 and the rear panel 20.

Thereafter, the rear of the mirrors and frames is treated first with a sealing and protective material, and after the back of the mirror has been positioned and the whole has been closed in a mould, the volume 22 of space is filled with the polyurethane-type synthetic foam material.

It can be seen that a large mirror produced in this way possesses characteristics of solidity, light weight, economy, aesthetic effect (owing to the use of the foam of a polyurethane type for instance, which unites and fixes by incorporation all the elements forming the large mirror, thus making welding unnecessary) and a practical nature (owing to insertion of the boxes 23–30, which permit the entry and introduction of electrical elements and owing to the angular elements 19 which make assembly quicker).

We claim:

1. A structure for supporting a mirror cabinet, cupboard doors, hanging cupboard doors with mirrors, or two-face partition panels with mirrors or other items, said structure comprising:

a plurality of lateral sections provided with means for supporting at least one mirror and a rear panel, wherein said lateral sections are joined by means of angular elements cooperating, respectively, with guiding means and with two adjacent lateral sections;

a volume of space being delimited by said lateral sections, at least one said mirror and said rear panel, wherein said lateral sections comprise means for supporting said rear panel, and an injected foam material means which binds solidly together all the elements forming said mirror cabinet fills up said volume of space.

2. A structure as claimed in claim 1, wherein said lateral sections comprise openings for housing standardized boxes suitable for enclosing electrical connection and actuation elements.

3. A structure as claimed in claim 1, in which the rear of the mirrors comprises a thin film obtained by means of a surface sealing treatment for preventing the exit of the foam material means and for providing protection against chemical attack.

4. A structure as claimed in claim 1, which comprises spacer elements for providing an air space between said mirror cabinet and a support wall.

5. A structure as claimed in claim 1, in which said angular elements comprise holes cooperating with mirror support elements.

6. A structure as claimed in claim 1, in which said rear panel consists of a laminated or extruded plastic material, aluminized board, veneered panels, or another mirror.

* * * * *